US008498559B2

(12) United States Patent
Zess et al.

(10) Patent No.: US 8,498,559 B2
(45) Date of Patent: Jul. 30, 2013

(54) OIL PRESSURIZED FOAM ROLL

(75) Inventors: Martin F Zess, Churchville, NY (US); Jason M Lefevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 349 days.

(21) Appl. No.: 12/842,057

(22) Filed: Jul. 23, 2010

(65) Prior Publication Data

US 2012/0020708 A1 Jan. 26, 2012

(51) Int. Cl.
*G03G 15/20* (2006.01)

(52) U.S. Cl.
USPC ..... 399/325

(58) Field of Classification Search
USPC ..... 399/324–327
See application file for complete search history.

(56) References Cited

U.S. PATENT DOCUMENTS

| | | | | |
|---|---|---|---|---|
| 4,040,383 | A | 8/1977 | Vandervort | |
| 5,232,499 | A * | 8/1993 | Kato et al. | 118/244 |
| 6,434,357 | B1 | 8/2002 | Maul et al. | |
| 2002/0015603 | A1 * | 2/2002 | Kimura et al. | 399/325 |

* cited by examiner

*Primary Examiner* — Hoang Ngo

(57) ABSTRACT

This disclosure relates to a lubricating supply system for a fuser assembly of a printing process having a perforated sleeve, the perforated sleeve supporting a semi-porous foam roll. The perforated sleeve slips around the outer surface of a rotating shaft in order that the lubricant supplied to the hollow of the rotating shaft is diffused through the perforated sleeve and foam roll to lubricate a heated surface of the fuser assembly. A lubricant port connects a source of lubricant to the hollow portion of the rotating shaft.

9 Claims, 2 Drawing Sheets

OIL PRESSURIZED FOAM ROLL

BACKGROUND

1. Field of the Technology

Figure 1:
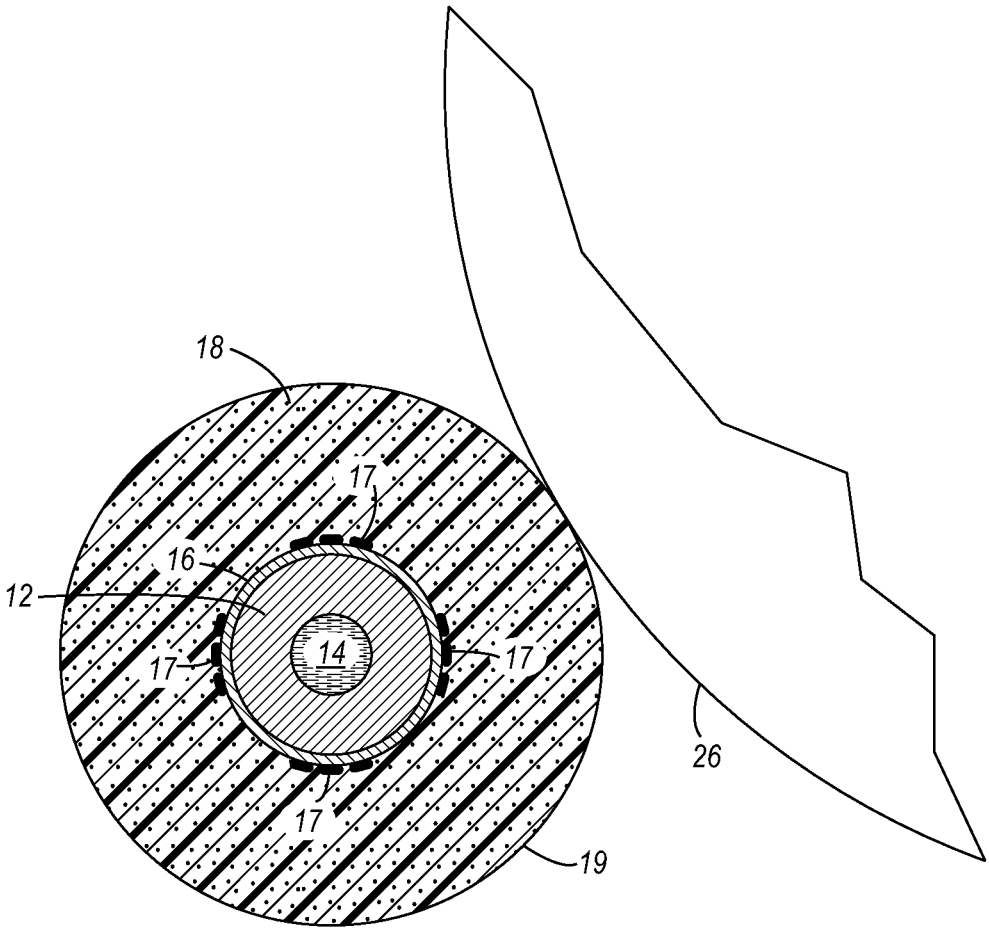

The present disclosure is applicable to the application of lubricant such as oil to a fuser roll, in particular, to the uniform application of oil across a foam roll.

2. Description of the Prior Art

Electro-photographic processes such as that used in printers, copiers, and fax machines produce hardcopy images on a print media such as paper through precise deposition of toner onto the print media. The toner is applied by the print mechanism to correspond to the desired text or image to be produced. Such toner is then permanently affixed to the media by a fuser, which heats the toner such that it melts and bonds to the print media.

Typically, the fuser mechanism comprises at least two contiguous rollers, a hot roller and a backup roller. The media is transported to the print mechanism and passes between the contiguous rollers, such that fuser hot roller heats the media to melt and fuse the toner to the print media. As the toner melts, it becomes tacky and has a tendency to adhere to the fuser hot roller. Over time, toner accumulates on the hot roller, and eventually on the backup roller, causing degradation of the image quality on the print media.

Application of a lubricating substance to the surface of the fuser hot roller serves to weaken the bond between the toner and the hot roller and prevents accumulation of toner on the hot roller, and also serves to smooth the toner surface. Silicone oil is one such lubricating substance which has effective toner repelling properties. Alternatively, such oil can be applied to the backup roller, and then transferred to the fuser hot roller due to rotational association of the backup roller or other fuser roller with the fuser hot roller.

There are a variety of prior art oil delivery systems to apply lubricant to the fuser hot roller. Oil webs, oil wicking systems, and oil delivery rolls have been employed to provide a controlled supply of oil to the hot roller. For example, one prior art oil delivery system uses an oil web extending from a web supply roller to a web take-up roller. The web is generally a fabric material held in contact with the fuser hot roller by one or more biasing rollers. Oil delivery is controlled by indexing the web by controlled rotation of the take-up and supply rolls.

Another prior art oil delivery system utilizes a wicking element biased against the fuser hot roller by a spring loaded or other biasing member. The wicking element is a piece of fibrous textile or mesh material adapted to transport silicone oil through capillary action. The wicking element extends from an oil reservoir to the hot roller and delivers silicone oil along the length of the fuser hot roller.

Such prior art mechanisms, as shown in U.S. Pat. No. 6,434,357, however, often increase the complexity of the system by adding moving parts or increase maintenance. Further, as such oil delivery systems tend to promote a continuous oil flow, an idle period between printing cycles can result in a surge of oil, called an oil dump, during a successive print phase. Such oil dumps can compromise the finished print quality, and further can damage the printer if excess oil leaks onto other components.

Another prior art device, as shown in U.S. Pat. No. 6,434,357 shows a tank-type oil roller which uses a hollow support shaft as an oil reservoir. The hollow support shaft has oil delivery holes along the length for delivering oil to a metering material, such as rolled fabric, which is wrapped around the hollow support shaft. Such an oil delivery system, however, does not include a buffering and replacement sleeve and requires the entire system to be replaced for maintenance or replenishment, including the hollow core. This can be costly as well as time consuming.

It should also be noted that a spreader roll is often used in lubricating a fuser system. For example, U.S. Pat. No. 4,040,383 shows an apparatus for uniformly applying toner-release lubricant to, and for cleaning, heated fusing rolls used in copying or reproduction machines. The apparatus comprises a lubricant-dispensing roll containing an internal supply of lubricant; an applicator roll for transferring lubricant from the dispenser roll to the fuser roll and for wiping the fuser roll; and a spreader roll for evenly distributing the lubricant on the applicator roll prior to the completion of transfer to the fuser roll.

Also, in ink jet printing systems, water-based inks or phase-change inks are used to form images on media. Phase-change inks are solids, which are heated to form a liquid phase. The liquid phase ink is applied to a medium on which the ink solidifies to form images. Such ink jet printing apparatus can include a spreader roll and a pressure roll, which define a nip. These rolls apply heat and pressure to a printable medium, such as paper. The spreader spreads ink drops applied to the medium.

It would be beneficial, therefore, to develop a lubricant delivery system which reduces the number and complexity of moving parts and avoids undue maintenance and replacement of parts, while still providing a carefully metered supply of oil to the fuser or spreader roller.

SUMMARY OF THE DISCLOSURE

This disclosure relates to a semi-porous foam roller with oil pumped to the center of the hollow core. The oil soaks into the foam roller and is transferred to the spreader roll. The foam roll, secured to a perforated sleeve that slips onto the hollow core, is a low cost item to change when worn out and the core remains with the machine and is not replaced. The oil pressurizes the space between the core and the foam roll making sure that the foam roll rotates on an oil seal. Holes are drilled into the core to allow the oil access to the foam roll.

Figure 2:
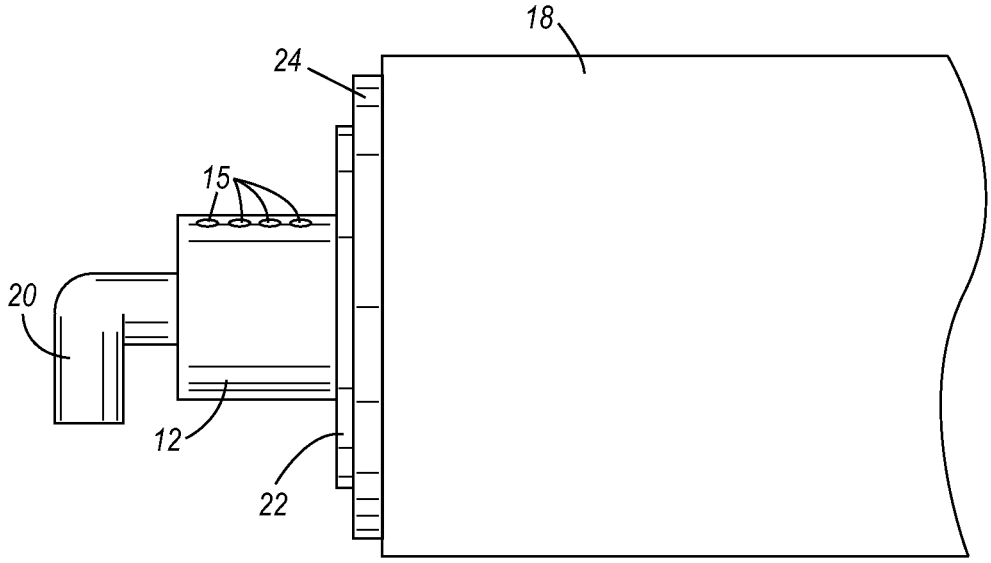

Various of the above-mentioned and further features and advantages will be apparent to those skilled in the art from the specific apparatus and its operation or methods described in the example below, and the claims. Thus, they will be better understood from the description of this specific embodiment including the drawing figures wherein:

FIG. 1 is a cross-section view of a lubricant delivery system as defined by the present disclosure; and FIG. 2 illustrates a side view of the lubricant delivery system of FIG. 1.

DETAILED DESCRIPTION OF THE DISCLOSURE

In operation, a foam roll is mounted on a sleeve and the sleeve includes perforations through it to allow passage of the oil. The sleeve could even be made of a semi-rigid screen. The foam roll and the screen assembly are slid over a shaft with a hollow center. Oil is pumped down the shaft and diffuses through the perforations in the sleeve into the foam roll from small holes that are drilled into the shaft connecting the hollow core to the foam roll. The placement of the holes, preferably, is at the top of the shaft in order that the oil would not drain from the shaft into the foam overnight.

With reference to FIG. 1, there is shown an exemplary lubrication device (cross sectional view) for a fuser system, in, particular, a steel core 12 with hollow center 14 filled with lubricant such as oil. The lubricant diffuses through holes drilled into the core 12 and through suitable perforations as illustrated at 17 through a steel sleeve 16 to saturate a foam roll 18. It should be noted that the holes in the shaft or steel core 12 are only drilled under the portion of the steel core 12 underneath the foam roll 18 surface. However, holes 15 in FIG. 2 are not actually drilled at the location shown, but holes 15 merely illustrate the general location of holes actually drilled in that portion of the steel core that is covered by foam roll 18. Sleeve 16 provides a support for the foam roll 18 and a buffer from the steel core 12. It should be noted also that the steel sleeve 16 and foam roll 18 are a replaceable unit for continued performance and maintenance of the lubrication device, without the need to remove or replace the steel core 12.

The perforations 17 are located and sized to allow an appropriate amount of lubricant to diffuse through the foam roll 18 for the necessary lubricant to be provided at the surface 19 of the foam roll 18. The surface 19 of foam roll 18 engages the heated spreader roll 26 to suitably convey lubricant to the spreader roll 26. In turn, the heated spreader roll forms a nip with another roll in the fusing operation or conveys the lubricant to another hot roll in a fusing operation. The purpose of the lubricant is to prevent solid ink from sticking to the hot spreader roll during a spreading process.

As illustrated in FIG. 2 (side view), a lubricant or oil port 20 is connected to one end of the steel core 12 to convey lubricant under pressure to the hollow or center of the steel core. Thus, there is a lubricant feed directly to the interior of the donor roll, and a means to control the lubricant pressure within the center of the foam roll core. It should be noted that the control of the pressure of the lubricant in the steel core 12 provides another means to control the amount of lubricant diffused through the sleeve 16 and foam roll 18 to provide an appropriate amount of lubricant at the surface 19 of the foam roll 18.

A combination of the oil seal retaining clip 22 and lubricant or oil seal 24 secure the foam roll 18 to the steel core 12 and oil port 20. The lubricant is forced into the hollow center 14 of steel core 12 and under suitable pressure is driven through the holes 15 on the surface of the core 12 and through the perforations 17 in the steel sleeve 16. The holes 15 on the surface of core 12 can be customized to the speed of the process or specific lubricant rate requirements.

Normally in the prior art, particularly in the type of system having lubricant dripped onto the surface of the foam roll 18, routine maintenance requires that the whole system, foam roll 18 and steel core 12 be replaced. However, according to the teaching of this disclosure, as discussed, it is only necessary to replace the foam roll 18 and steel sleeve 16 for routine maintenance. Thus, the steel sleeve 16 provides a quick change mechanism and a lubricant film base for rotation.

Thus, in accordance with the teachings of this disclosure, a semi-porous foam roll is secured to a perforated sleeve that slips onto a hollow steel core. The perforated sleeve along with the foam roll is a low cost item to change when worn out. The steel core remains with the machine and is not be replaced.

Oil is pumped into the center of a hollow steel core and the oil pressure in the space between the steel core and the foam roll insures that the foam roll rotates on a lubricant seal. There would be holes drilled into the core to allow the oil access to the foam roll through the perforated sleeve. The oil soaks into the foam roller and is transferred to the spreader roll.

It should be noted that, although various features have been disclosed, such as a lubricant feed directly to the interior of the donor roll, lubricant pressure at the center of the foam roll core, a quick change sleeve rotating on an oil film, and lubricant ports in the core that can be customized to the speed of the process or the oil rate requirements, various alternatives of the perforated sleeve and fuser lubricating system are contemplated within this disclosure.

Further, the disclosed system allows various benefits such as allowing the foam roll to be mounted onto a steel sleeve and slid onto a steel, lubricant filled core. This saves the cost of the steel core and the transportation costs to re-manufacture the roll. Also the disclosed configuration allows the lubricant rate on the spreader roll to be determined by the speed of the oil pump and not based on the nip formed between the foam roll and the spreader roll. Also noted is that the center oil feed distributes the oil more uniformly than the oil delivery tube.

It should be apparent, therefore, that while specific embodiments of the present disclosure have been illustrated and described, it will be understood by those having ordinary skill in the art to which this invention pertains, that changes can be made to those embodiments without departing from the spirit and scope of the disclosure. Further, The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What we claim is:

1. A lubricating supply system for a spreader assembly of a printing process comprising:

a hollow shaft having preselected holes;

a lubricant port, the lubricant port connecting a source of lubricant to the hollow portion of the shaft;

a perforated sleeve, the perforated sleeve supporting a semi-porous, open cell foam roll, the perforated sleeve engaging the outer surface of the shaft whereby lubricant supplied to the hollow of the shaft is diffused through the preselected holes and perforated sleeve and foam roll to lubricate a heated surface of the spreader assembly wherein the perforated sleeve slips onto the hollow core and wherein the perforated sleeve and foam roll comprise a replacement combination for maintenance of the spreader assembly.

2. The lubricating supply of claim 1 wherein the lubricant pressurizes the space between the hollow core and the foam roll to provide a lubricant buffer.

3. The lubricating supply system of claim 1 including a heated spreader roll forming a nip with the foam roll.

4. The lubricating supply system of claim 1 wherein the perforated sleeve is a semi-rigid screen.

5. A spreader assembly in a printing system including a shaft; a lubricant material disposed within the hollow of the shaft, the shaft including preselected holes for delivery of lubricant to a perforated sleeve, the sleeve concentrically disposed about the shaft, a foam roll supported on the sleeve, and a heated roll of the spreader assembly forming a nip with the foam roll, wherein the lubricant is dispensed onto the heated roll to prevent tacking of ink type material to the surface of the heated roll, wherein the sleeve is perforated with holes and the sleeve and foam roll provide a metered layer of lubricant to the surface of the heated roll, and wherein the perforated sleeve and foam roll comprise a replacement combination for maintenance of the spreader assembly.

6. The spreader assembly of claim 5 including a source of lubricant material pumped into the hollow of the shaft.

7. The spreader assembly of claim 5 wherein the heated roll forms a spreader nip to secure ink type material to a substrate.

8. The spreader assembly of claim 5 wherein the heated roll is a spreader roll.

9. The spreader assembly of claim 5 wherein the lubricant pressurizes the space between the hollow core and the foam roll to provide a lubricant seal for rotation of the foam roll.

* * * * *